US005212330A

United States Patent [19]

Cooper

[11] Patent Number: 5,212,330

[45] Date of Patent: May 18, 1993

[54] MECHANICAL GUITAR STRUMMER

[76] Inventor: Michael P. Cooper, 6424 Central City Blvd. #334, Galveston, Tex. 77551

[21] Appl. No.: 742,364

[22] Filed: Aug. 8, 1991

[51] Int. Cl.[5] ..... G10D 3/00

[52] U.S. Cl. ..... 84/320

[58] Field of Search ..... 84/312 P, 312 R, 320–322, 84/460, 721, 746, 7–9

[56] References Cited

U.S. PATENT DOCUMENTS

| | | | |
|---|---|---|---|
| 921,565 | 5/1909 | Scarlett | 84/320 |
| 2,006,998 | 7/1935 | Marzullo | 84/320 |
| 2,251,472 | 8/1941 | Sylvester | 84/320 |
| 3,319,502 | 5/1967 | Hackney | 84/320 |
| 3,443,468 | 5/1969 | Kidwell | 84/320 |
| 3,521,516 | 7/1970 | Gibbons | 84/9 |
| 3,603,192 | 9/1971 | Kaar | 84/320 X |
| 4,156,380 | 5/1979 | Fulton | 84/171 |

*Primary Examiner*—William M. Shoop, Jr.
*Assistant Examiner*—Jeffrey W. Donels

[57] ABSTRACT

A device is provided for playing a stringed instrument such as a guitar through use of one hand. Two foot pedals are provided with cables attached to a structure mounted on the stringed instrument. One pedal controls the pick movement across the strings of the instrument while the other pedal engages and disengages the pick as well as controls the intensity of strum. The device allows a person having use of only one hand to strum or pluck a stringed instrument with versatility and quality sound. The device is light in weight and may be set up in a short period of time because such device is simple but reliable and may be used with a variety of instruments having from one through twelve strings. The device is designed primarily for a disabled individual, but could also be used by a talented musician who wishes to play more than one instrument at a time.

1 Claim, 2 Drawing Sheets

FIG. 1
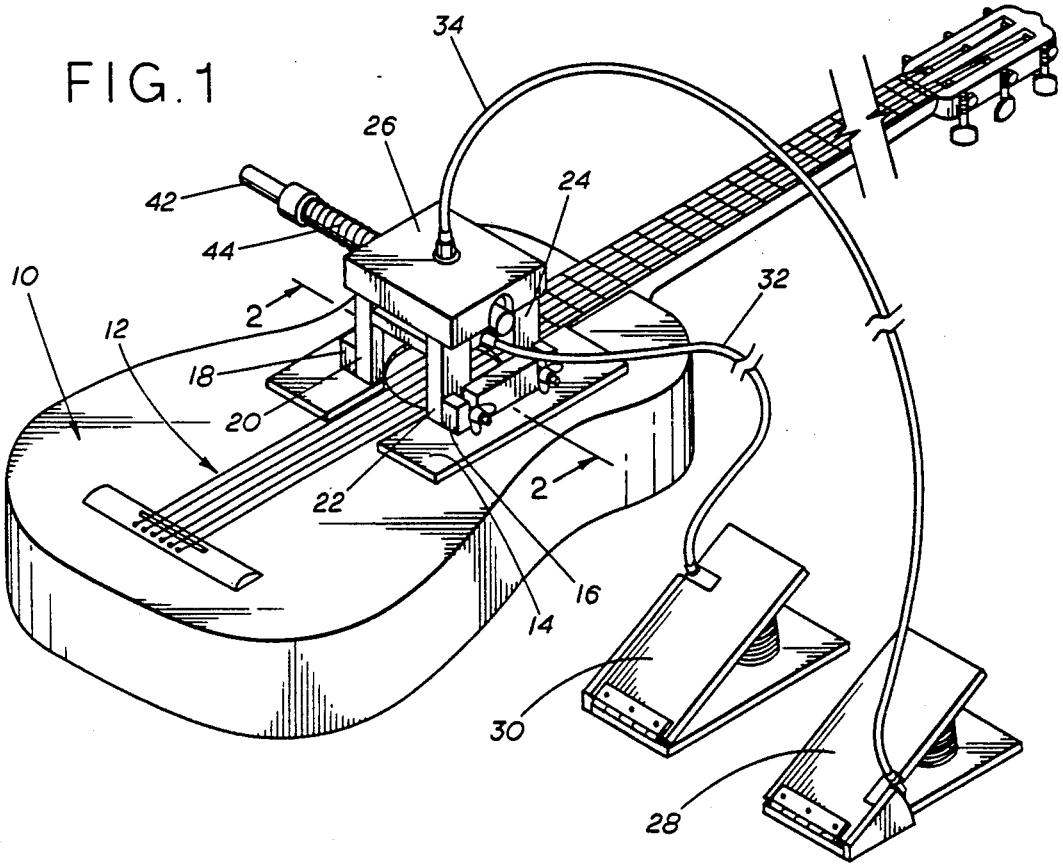
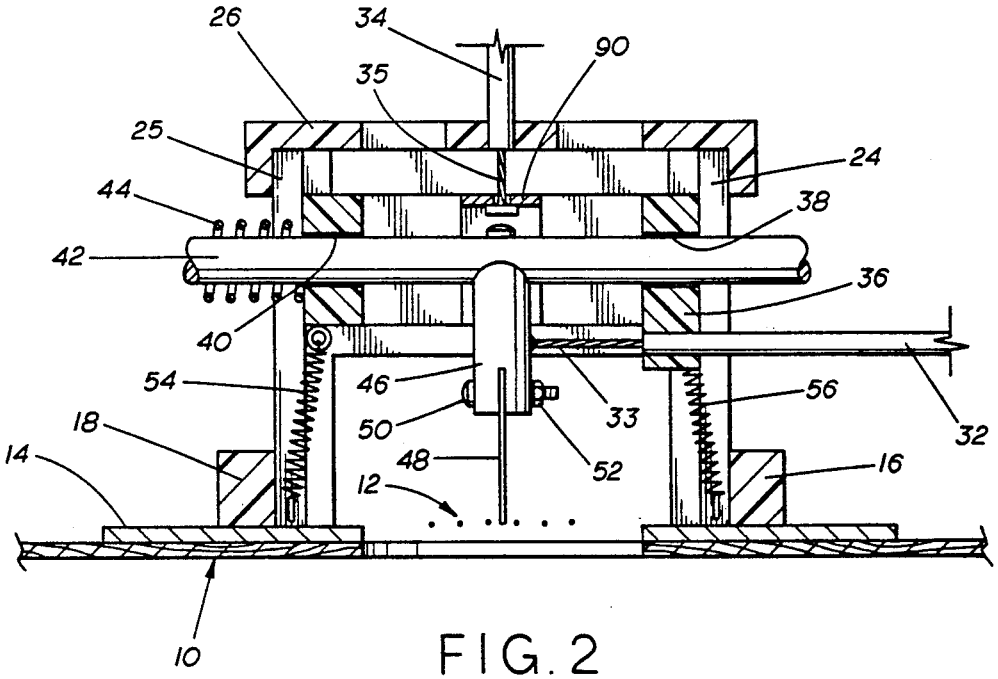
FIG. 2

MECHANICAL GUITAR STRUMMER

BACKGROUND OF THE INVENTION

I. Field of the Invention

The present invention pertains to a device for strumming a stringed instrument such as a guitar through use of two foot pedals and one hand of an individual.

II. Description of the Related Art

Prior art known to the applicant includes U.S. Pat. No. 2,380,689 issued Jul. 31, 1945 to Goodwin for "Attachment for Musical Stringed Instruments", U.S. Pat. No. 2,251,472 issued Aug. 5, 1941 to Sylvester for "Foot-Operated Guitar Player", and U.S. Pat. No. 3,603,192 issued Sep. 7, 1971 to Kaar for "Foot-Operated Base-Stringed Musical Instrument". The devices disclosed in these patents generally are bulky, heavy, and do not allow strumming of individual strings of a string instrument such as a guitar. The playing options available to an individual utilizing the devices shown in these prior art patents are very limited and such devices are difficult to operate and assemble.

SUMMARY OF THE INVENTION

A mechanical device for strumming a stringed instrument such as a guitar is provided for attachment to a conventional stringed instrument such as a guitar. A support assembly is attached to the guitar and a frame is attached to the support assembly. A pick is positioned in a pick holder in the frame. Two pedals are connected to the pick holder in the frame through cables to provide vertical and horizontal movement of the pick on the strings of the guitar. Only one hand of an individual playing the guitar is required to select notes and chords while the feet of the individual are positioned on the pedals.

BRIEF DESCRIPTION OF THE DRAWINGS

FIG. 1 is an upper, perspective view of the mechanical guitar strummer of the present invention;

FIG. 2 is a cross-sectional, elevational view taken along line 2—2 of FIG. 1.

DESCRIPTION OF THE PREFERRED EMBODIMENT

Figure 3:
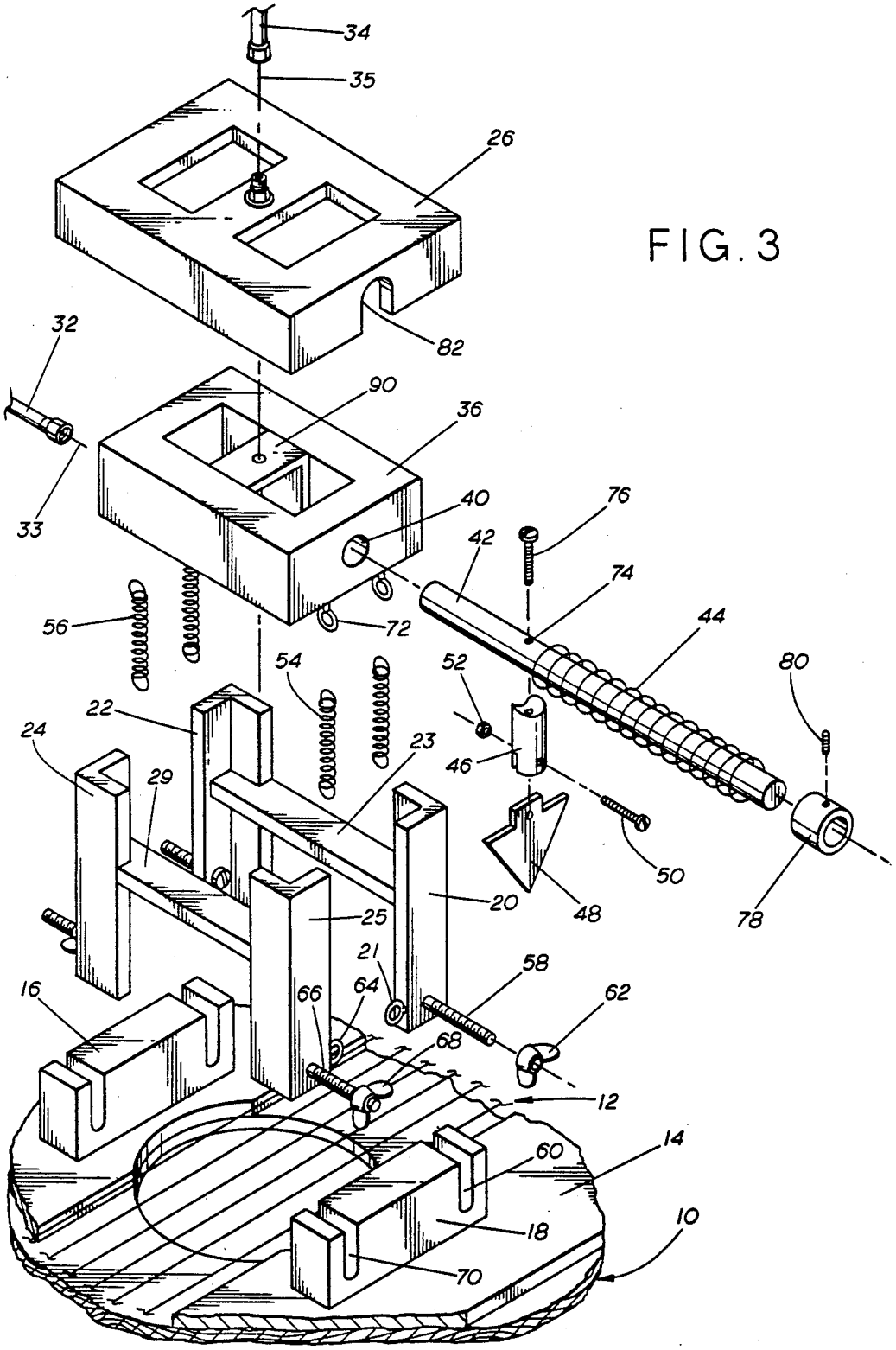
FIG. 3 is an exploded, perspective view of the support assembly as attached to a guitar.

FIG. 1 is an upper, perspective view of the mechanical guitar strummer of the present invention. A conventional acoustic guitar 10 having a plurality of strings 12 is shown with the assembly of the present invention attached to such acoustic guitar. A pick guard 14 is positioned on the acoustic guitar 10 wit first base 16 and second base 18 positioned on the pick guard 14. A plurality of legs such as leg 20, 22, and 24 are positioned between first base 16 and second base 18 and provide support to the pick means which include a rod housing and a lid 26.

A first pedal 28 and a second pedal 30 are provided with a cable assembly 34 and a cable assembly 32. Cable assembly 34 goes to the lid 26 while cable assembly 32 goes to the pick holder 46.

In viewing FIG. 1, it will be appreciated that pedal 28 and pedal 30 may be manipulated by the feet of the individual who is playing the guitar thereby making it possible for a person having the use of only one hand to utilize the device of the present invention.

FIG. 2 is a cross-sectional, elevational view taken along line 2—2 of FIG. 1. Acoustic guitar 10 having strings 12 has pick guard 14 attached. Positioned on the pick guard 14 is first base 16 and second base 18. Leg 24 and leg 25 provide support for lid 26. Rod housing 36 has an opening 38 and an opening 40 to allow positioning of rod 42 in opening 38 and in opening 40. A compression spring 44 is positioned over rod 42 and against rod housing 36 to provide a default or return position for the pick holder 46. The pick holder 46 has a pick 48 attached through suitable fastening means such as bolt 50 and nut 52.

Tension spring 54 and tension spring 56 are connected between leg 25 and the rod housing 36 and between leg 24 and the rod housing 36.

The tension springs 54 and 56 act to provide normal positioning of the rod housing 36. Cable assembly 34 having cable 35 is connected to bracket 90 to allow upward movement of pick 48 when pedal 28 connected to cable assembly 34 is operated.

Cable assembly 32 having cable 33 is attached to pick holder 46 to provide movement of the pick 48 in a direction perpendicular to the movement provided by cable 35. Cable 33 in cable assembly 32 is manipulated by pedal 30.

Thus, it will be appreciated in viewing FIG. 2 that a support assembly is provided with a frame positioned on the support assembly. Pick means including a pick holder and a pick are positioned in the frame and first and second pedals are connected to the pick means to provide selective vertical movement and selective horizontal movement of the pick means thereby allowing the strings of the guitar to be collectively strummed or individually picked.

FIG. 3 is an exploded perspective view of the support assembly of the present invention. Acoustic guitar 10 having strings 12 has pick guard 14 positioned on the acoustic guitar 10. Second base 18 and first base 16 are positioned on the pick guard 14. Leg 20 has an eyelet 21 and a threaded bolt 58. Brace 23 connects leg 20 and leg 22. Threaded bolt 58 fits in opening 60 of the second base 18 and a wing nut 62 allows leg 20 to be rigidly positioned against second base 18.

Leg 25 has an eyelet 64, a threaded bolt 66 and a wing nut 68. Threaded bolt 66 is positioned in opening 70 of second base 18 to allow fixed positioning as explained previously in connection with leg 20.

Tension spring 54 is positioned between eyelet 64 of leg 25 and eyelet 72 of rod housing 36. Similarly, tension spring 56 is positioned to leg 24 and rod housing 36. Brace 29 connects leg 24 and leg 25.

It will be appreciated that the arrangement explained in connection with tension springs 54 and 56 is utilized with respect to the two other tension springs shown.

Rod housing 36 has opening 40 in which is positioned rod 42. Rod 42 has an opening 74 to accommodate bolt 76 which is connected to pick holder 46 having pick 48 held in position by bolt 50 and nut 52.

The compression spring 44 has a collar 78 positioned on one end and held in position by bolt 80.

Cable assembly 32 has cable 33 attached to the pick holder 46. Cable assembly 34 having cable 35 is connected through lid 26 to bracket 90. Lid 26 has a opening 82 to accommodate rod 42.

As explained previously, the manipulation of cable 35 and cable 33 by the foot pedals provides movement of the pick 48 across the strings of the guitar and upward away from the strings so that any one of the strings may be picked. The pedals may be positioned to be operated by either one of the feet. The provision of picking individual strings is an important feature of the present invention since it allows versatility and better sound than any of the devices of the prior art.

Thus, a device is provided in accordance with the present invention to allow strumming and picking of a stringed instrument such as a guitar through the use of only one hand. Also, the device of the present invention might conceivably be used with only foot pedals for a harp type instrument. Also, an attachment to may be made to one of the cables to replace a foot pedal and allow the instrument to be played with one hand, one foot, and some other body motion such as movement of a knee.

Although a preferred embodiment of the invention has been shown and described in accordance with the requirements of the United States patent Laws, it will be appreciated by those skilled in the art to which the present invention pertains that many modifications and improvements may be made without departing from the spirit of the invention as defined by the claims.

I claim:

1. Apparatus without electronic circuitry for strumming a string musical instrument by a one-armed player, said apparatus including in combination a support assembly having first and second elongated members, a frame positioned on said support assembly, pick means including a pick holder and a pick positioned in said frame, and first and second pedal means each having a cable connected to a foot pedal and connected to said pick means, said first pedal means providing selective vertical movement of said pick means and said second pedal means providing selective horizontal movement of said pick means.

* * * * *